US005576285A

United States Patent [19]

France et al.

[11] Patent Number: 5,576,285

[45] Date of Patent: Nov. 19, 1996

[54] PROCESS FOR MAKING A LOW DENSITY DETERGENT COMPOSITION BY AGGLOMERATION WITH AN INORGANIC DOUBLE SALT

[75] Inventors: Paul A. France, West Chester; Steven B. Rogers, Cincinnati, both of Ohio; Wayne E. Beimesch, Covington, Ky.

[73] Assignee: The Procter & Gamble Company, Cincinnati, Ohio

[21] Appl. No.: 539,212

[22] Filed: Oct. 4, 1995

[51] Int. Cl.[6] ..... C11D 11/00; C11D 11/04; C11D 3/10

[52] U.S. Cl. ..... 510/444; 510/509; 264/117; 264/140

[58] Field of Search ..... 252/89.1, 174, 252/135, 174.14, 174.25; 264/117, 140; 510/444, 509

[56] References Cited

U.S. PATENT DOCUMENTS

| | | | |
|---|---|---|---|
| 3,640,875 | 2/1972 | Rubin et al. | 252/99 |
| 4,115,308 | 9/1978 | Guerry | 252/135 |
| 4,151,266 | 4/1979 | Robey et al. | 423/425 |
| 4,818,424 | 4/1989 | Evans et al. | 252/91 |
| 4,820,441 | 4/1989 | Evans et al. | 252/174.24 |
| 4,882,074 | 11/1989 | Kenyon et al. | 252/8.8 |
| 4,900,466 | 2/1990 | Atkinson et al. | 252/174.14 |
| 4,992,079 | 2/1991 | Lutz | 23/313 R |
| 5,108,646 | 4/1992 | Beerse et al. | 252/174.25 |
| 5,133,924 | 7/1992 | Appel et al. | 264/342 R |
| 5,160,657 | 11/1992 | Bortolotti et al. | 252/174.14 |
| 5,205,958 | 4/1993 | Swatling et al. | 252/174.13 |
| 5,366,652 | 11/1994 | Capeci et al. | 252/89.1 |

FOREIGN PATENT DOCUMENTS

| | | |
|---|---|---|
| 886828 | 11/1971 | Canada . |
| 0351937A1 | 1/1990 | European Pat. Off. . |
| 0451894A1 | 10/1991 | European Pat. Off. . |
| 1517713 | 7/1978 | United Kingdom . |
| 1591516 | 6/1981 | United Kingdom . |

OTHER PUBLICATIONS

Research Disclosure Apr. 1990, #312101, *Detergent Powder Production,* pp. 358–359.

*Primary Examiner*—Paul Lieberman
*Assistant Examiner*—Lorna M. Douyon
*Attorney, Agent, or Firm*—Ken K. Patel; Jacobus C. Rasser; Jerry J. Yetter

[57] ABSTRACT

A process for continuously preparing low density detergent agglomerates having a density of below about 500 g/l is provided. The process comprises the steps of: (a) agglomerating a detergent surfactant paste or liquid acid precursor of anionic surfactant and dry starting detergent material in a high speed mixer to obtain detergent agglomerates, wherein the dry starting detergent material includes an inorganic double salt and sodium carbonate in a weight ratio of from about 1:10 to about 10:1; and (b) drying the detergent agglomerates so as to form the low density detergent composition having a density below about 600 g/l.

13 Claims, No Drawings

PROCESS FOR MAKING A LOW DENSITY DETERGENT COMPOSITION BY AGGLOMERATION WITH AN INORGANIC DOUBLE SALT

FIELD OF THE INVENTION

The present invention generally relates to a process for producing a low density detergent composition. More particularly, the invention is directed to a continuous process during which low density detergent agglomerates are produced by feeding a surfactant paste or liquid acid precursor of anionic surfactant and dry starting detergent material including an inorganic double salt into a high speed mixer. The process produces a free flowing, low density detergent composition which can be commercially sold as a conventional non-compact detergent composition or used as an admix in a low dosage, "compact" detergent product.

BACKGROUND OF THE INVENTION

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modern detergent products need to be "compact" in nature remains unsettled. In fact, many consumers, especially in developing countries, continue to prefer a higher dosage levels in their respective laundering operations. Consequently, there is a need in the art of producing modern detergent compositions for flexibility in the ultimate density of the final composition.

Generally, there are two primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity and surface area, shape of the various starting materials and their respective chemical composition. These parameters, however, can only be varied within a limited range. Thus, flexibility in the substantial bulk density can only be achieved by additional processing steps which lead to lower density of the detergent granules.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, toughened, rotatable table positioned within and at the base of a substantially vertical, smooth walled cylinder. This process, however, is essentially a batch process and is therefore less suitable for the large scale production of detergent powders. More recently, other attempts have been made to provide continuous processes for increasing the density of "post-tower" or spray dried detergent granules. Typically, such processes require a first apparatus which pulverizes or grinds the granules and a second apparatus which increases the density of the pulverized granules by agglomeration. While these processes achieve the desired increase in density by treating or densifying "post tower" or spray dried granules, they do not provide a process which has the flexibility of providing lower density granules.

Moreover, all of the aforementioned processes are directed primarily for densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of detergents in a more efficient manner. Thus, it would be desirable to have a process by which detergent compositions can be produced without having the limitations imposed by conventional spray drying techniques.

To that end, the art is also replete with disclosures of processes which entail agglomerating detergent compositions. For example, attempts have been made to agglomerate detergent builders by mixing zeolite and/or layered silicates in a mixer to form free flowing agglomerates. While such attempts suggest that their process can be used to produce detergent agglomerates, they do not provide a mechanism by which a starting detergent materials in the form of pastes, liquids and dry materials can be effectively agglomerated into crisp, free flowing detergent agglomerates having low densities.

Accordingly, there remains a need in the art to have a process for continuously producing a low density detergent composition directly from starting detergent ingredients. Also, there remains a need for such a process which is more efficient, flexible and economical to facilitate large-scale production of detergents of low as well as high dosage levels.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894. The following references are directed to producing detergents by agglomeration: Beerse et al, U.S. Pat. No. 5,108,646 (Procter & Gamble); Capeci et al, U.S. Pat. No. 5,366,652 (Procter & Gamble); Hollingsworth et al, European Patent Application 351,937 (Unilever); and Swatling et al, U.S. Pat. No. 5,205,958. The following references are directed to inorganic double salts: Evans et al, U.S. Pat. No. 4,820,441 (Lever); Evans et al, U.S. Pat. No. 4,818,424 (Lever); and Atkinson et al, U.S. Pat. No. 4,900,466 (Lever).

SUMMARY OF THE INVENTION

The present invention meets the aforementioned needs in the art by providing a process which produces a low density (below about 600 g/l) detergent composition directly from starting ingredients including an inorganic double salt. The process does not use the conventional spray drying towers currently used and is therefore more efficient, economical and flexible with regard to the variety of detergent compositions which can be produced in the process. Moreover, the process is more amenable to environmental concerns in that it does not use spray drying towers which typically emit particulates and volatile organic compounds into the atmosphere.

As used herein, the term "agglomerates" refers to particles formed by agglomerating detergent granules or particles which typically have a smaller mean particle size than the formed agglomerates. As used herein, the phrase "at least a minor amount" of water means an amount sufficient to aid in agglomeration, typically on the order of 0.5% to about 15% by weight of the total amount of water contained in the mixture of all starting components. All percentages used herein are expressed as "percent-by-weight" unless indicated otherwise. All viscosities described herein are measured at 70° C. and at shear rates between about 10 to 50 $sec^{-1}$, preferably at 25 $sec^{-1}$.

In accordance with one aspect of the invention, a process for preparing low density detergent agglomerates is provided. The process comprises the steps of: (a) agglomerating a detergent surfactant paste and dry starting detergent material in a high speed mixer to obtain detergent agglomerates, wherein the dry starting detergent material includes an inorganic double salt and sodium carbonate in a weight ratio of from about 1:10 to about 10:1; and (b) drying the detergent agglomerates so as to form the low density detergent composition having a density of less than about 600 g/l.

In accordance with another aspect of the invention, another process for preparing low density detergent agglomerates is provided. The process comprises the steps of: (a) agglomerating a detergent surfactant paste and dry starting detergent material in a high speed mixer to obtain detergent agglomerates, wherein the dry starting detergent material includes $Na_2SO_4.Na_2CO_3$ and sodium carbonate in a weight ratio of from about 1:10 to about 10:1; (b) mixing the detergent agglomerates in a moderate speed mixer to further agglomerate the detergent agglomerates; and (c) drying the detergent agglomerates so as to form the low density detergent composition having a density of below about 600 g/l.

In accordance with yet another aspect of the invention, another process for preparing a low density detergent composition is provided. This process comprises the steps of: (a) agglomerating a liquid acid precursor of anionic surfactant and dry starting detergent material in a high speed mixer to obtain detergent agglomerates, wherein the dry starting detergent material includes an inorganic double salt and sodium carbonate in a weight ratio of from about 1:10 to about 10:1; and (b) cooling the detergent agglomerates so as to form the detergent composition having a density of below about 600 g/l. Also provided are the low density detergent products produced by any one of the process embodiments described herein.

Accordingly, it is an object of the invention to provide a process for continuously producing a low density detergent composition directly from starting detergent ingredients. It is also an object of the invention to provide a process which is more efficient, flexible and economical to facilitate large-scale production of detergents of low as well as high dosage levels. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, low density detergent agglomerates having a density of less than about 600 g/l, preferably less than about 500 g/l. The process produces low density detergent agglomerates from a highly viscous surfactant paste having a relatively high water content, typically at least about 10%, or a liquid acid precursor of anionic surfactant which is then neutralized with the sodium carbonate in the dry starting detergent ingredients during the agglomeration step. Generally speaking, the present process is used in the production of normal as opposed to low dosage detergents whereby the resulting detergent agglomerates can be used as a detergent or as a detergent additive. It should be understood that the process described herein can be continuous or batch depending upon the desired application.

Process

In the first step of the process, starting detergent materials are fed into a high speed mixer for agglomeration. To achieve the desired density of less than about 600 g/l, the agglomeration step is carried forth in a high speed mixer after which an optional moderate speed mixer may be used for further agglomeration if necessary, wherein the starting detergent materials are agglomerated in the presence of an inorganic double salt, preferably is anhydrous, and sodium carbonate. Preferably, the anhydrous inorganic double salt is $Na_2SO_4.Na_2CO_3$ (Burkeite), although other inorganic salts as noted below may be used. The preferred weight ratio of the inorganic salt to sodium carbonate is from about 1:10 to about 10:1, more preferably from about 1:5 to about 5:1, and most preferably from about 1:2 to about 3:1. The agglomerate particles preferably have a density most preferably of from about 300 g/l to about 500 g/l.

The nature and composition of the entering or starting detergent materials can vary as described in detail hereinafter. Preferably, the mean residence time of the starting detergent materials in the high speed mixer (e.g. Lödige Recycler CB 30 or other similar equipment) is from about 2 to 45 seconds while the residence time in low or moderate speed mixer (e.g. Lödige Recycler KM 600 "Ploughshare" or other similar equipment) is from about 0.5 to 15 minutes.

The starting detergent materials preferably include a highly viscous surfactant paste or a liquid acid precursor of anionic surfactant and dry detergent material, the components of which are described more fully hereinafter. For purposes of facilitating the production of low density or "fluffy" detergent agglomerates, the dry detergent material includes an inorganic salt material and sodium carbonate together which have been surprisingly found to lower the density of the agglomerates produced in the process. While not intending to be bound by theory, it is believed that the inorganic salt and sodium carbonate in the optimally selected weight ratio enhance the "fluffing" of the agglomerates as they are produced in the instant process. This leads to the production of agglomerates having the desired low density. To that end, the instant process preferably entails mixing from about 1% to about 60%, more preferably from about 20% to about 450% of the inorganic double salt, and from about 0.1% to about 50%, more preferably of 5% to about 10% of sodium carbonate, both of which are contained in the aforementioned weight ratio range.

The other essential step in the process involves drying the agglomerates exiting the high speed mixer or the moderate speed mixer if it is optionally used. This can be completed in a wide variety of apparatus including but not limited to fluid bed dryers. The drying and/or cooling steps enhance the free flowability of the agglomerates and continues the "fluffing" or "puffing" physical characteristic formation of the resulting agglomerates. While not intending to be bound by theory, it is believed that during the agglomeration step of the instant process, the inorganic double salt becomes embodied in the agglomerates and "puffs" the agglomerates into a fluffy, light, low density agglomerate particle. The inorganic double salt, such as $Na_2SO_4.Na_2CO_3$ (Burkeite), is preferably a high void volume, high integrity carrier particle that can absorb the surfactant paste while maintaining its shell-forming properties.

The detergent agglomerates produced by the process preferably have a surfactant level of from about 20% to about 55%, more preferably from about 35% to about 55% and, most preferably from about 45% to about 55%. The particle porosity of the resulting detergent agglomerates produced according to the process of the invention is preferably in a range frown about 5% to about 50%, more preferably at about 25%. In addition, an attribute of dense or densified agglomerates is the relative particle size. The present process typically provides detergent agglomerates having a mean particle size of from about 250 microns to about 1000 microns, and more preferably from about 400 microns to about 600 microns. As used herein, the phrase "mean particle size" refers to individual agglomerates and not individual particles or detergent granules. The combination of the above-referenced porosity and particle size results in agglomerates having density values of less than 600 g/l. Such a feature is especially useful in the production of laundry detergents having varying dosage levels as well as other granular compositions such as dishwashing compositions.

Optional Process Steps

In an optional step of the present process, the detergent agglomerates exiting the fluid bed dryer are further conditioned by additional cooling or drying in similar apparatus as are well known in the art. Another optional process step involves adding a coating agent to improve flowability and/or minimize over agglomeration of the detergent composition in one or more of the following locations of the instant process: (1) the coating agent can be added directly after the fluid bed cooler or dryer; (2) the coating agent may be added between the fluid bed dryer and the fluid bed cooler; (3) the coating agent may be added between the fluid bed dryer and the optional moderate speed mixer; and/or (4) the coating agent may be added directly to the optional moderate speed mixer and the fluid bed dryer. The coating agent is preferably selected from the group consisting of aluminosilicates, silicates, carbonates and mixtures thereof. The coating agent not only enhances the free flowability of the resulting detergent composition which is desirable by consumers in that it permits easy scooping of detergent during use, but also serves to control agglomeration by preventing or minimizing over agglomeration, especially when added directly to the moderate speed mixer. As those skilled in the art are well aware, over agglomeration can lead to very undesirable flow properties and aesthetics of the final detergent product.

Optionally, the process can comprise the step of spraying an additional binder in one or both of the mixers or fluid bed dryers. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized detergent agglomerates in a screening apparatus which can take a variety of forms including but not limited to conventional screens chosen for the desired particle size of the finished detergent product. Other optional steps include conditioning of the detergent agglomerates by subjecting the agglomerates to additional drying by way of apparatus discussed previously.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Detergent Surfactant Paste

The detergent surfactant paste used in the process is preferably in the form of an aqueous viscous paste, although forms are also contemplated by the invention. This so-called viscous surfactant paste has a viscosity of from about 5,000 cps to about 100,000 cps, more preferably from about 10,000 cps to about 80,000 cps, and contains at least about 10% water, more preferably at least about 20% water. The viscosity is measured at 70° C. and at shear rates of about 10 to 100 $sec.^{-1}$. Furthermore, the surfactant paste, if used, preferably comprises a detersive surfactant in the amounts specified previously and the balance water and other conventional detergent ingredients.

In an alternative embodiment of the process invention, the liquid acid precursor of anionic surfactant is used during the agglomeration step. This liquid acid precursor will typically have a viscosity of from about 500 cps to about 100,000 cps. The liquid acid is a precursor for the anionic surfactants described in more detail hereinafter.

The surfactant itself, in the viscous surfactant paste, is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,919,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the surfactant paste, or from which the liquid acid precursor described herein derives, include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)\ CH_3$ and $CH_3\ (CH_2)_y(CHOSO_3^-M^+)\ CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Optionally, other exemplary surfactants useful in the paste of the invention include and $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Dry Detergent Material

The starting dry detergent material of the present process preferably comprises the inorganic salt previously mentioned and sodium carbonate. In one preferred embodiment, the inorganic double salt is anhydrous and is $Na_2SO_4.Na_2CO_3$ (Burkeite). The weight ratio of $Na_2SO_4$ to $Na_2CO_3$ in Burkeite is preferably from 70:30, but 30:70 can also be without departing from the scope of the invention. While the inorganic salts listed herein are suitable for use in the instant process, other salts which have not been listed can be used. It is also preferable for the dry detergent material to include sodium carbonate as mentioned earlier, especially when the liquid acid precursor is used as a neutralizing agent in the agglomeration step.

The dry detergent material may also include a detergent aluminosilicate builder which are referenced as aluminosilicate ion exchange materials and sodium carbonate. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit the as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/-gram/gallon.

Adjunct Detergent Ingredients

The starting dry detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof (see below).

In comparison with amorphous sodium silicates, crystalline layered sodium silicates exhibit a clearly increased calcium and magnesium ion exchange capacity. In addition, the layered sodium silicates prefer magnesium ions over calcium ions, a feature necessary to insure that substantially all of the "hardness" is removed from the wash water. These crystalline layered sodium silicates, however, are generally more expensive than amorphous silicates as well as other builders. Accordingly, in order to provide an economically feasible laundry detergent, the proportion of crystalline layered sodium silicates used must be determined judiciously.

The crystalline layered sodium silicates suitable for use herein preferably have the formula $$NaMSi_xO_{2x+1}.yH_2O$$

wherein M is sodium or hydrogen, x is from about 1.9 to about 4 and y is from about 0 to about 20. More preferably, the crystalline layered sodium silicate has the formula $$NaMSi_2O_5.yH_2O$$

wherein M is sodium or hydrogen, and y is from about 0 to about 20. These and other crystalline layered sodium silicates are discussed in Corkill et al, U.S. Pat. No. 4,605,509, previously incorporated herein by reference.

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are tetraborate decahydrate and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylene malonic acid. Some of these materials are useful as the water-soluble anionic polymer as hereinafter described, but only if in intimate admixture with the non-soap anionic surfactant.

Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. Nos. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

In order to make the present invention more readily understood, reference is made to the following examples, which are intended to be illustrative only and not intended to be limiting in scope.

EXAMPLES I–II

These Examples illustrate a batch mode of the instant process. A low density agglomerated detergent composition is prepared using a lab tilt-a-pin™ (available from Processall, Inc.) mixer. The mixer is first charged with a mixture of powders, namely sodium carbonate (mean particle size 5–40 microns made via Air Classified Mill), light density sodium tripolyphosphate (supplied by FMC Corp. and referenced as "STPP")), zeolite type A (supplied by Ethyl Corp. and noted as below as "Zeolite A") and $Na_2SO_4.Na_2CO_3$ ("Burkeite"). The Burkeite is made in a Niro™ spray dryer. A 25% by weight aqueous solution of $Na_2SO_4.Na_2CO_3$ (wt. ratio 70/30) is sprayed in the spray dryer where the inlet air was 250° C. The liquid acid precursor of sodium alkylbenzene sulfonate ($C_{12}H_{25}$—$C_6H_4$—$SO_3$—H or "HLAS" as noted below) is then added on top of the powder mixture while the mixer was being operated for 15 seconds at 700 rpm. Surfactant paste is added until discrete granules are formed in the mixer. The composition of the agglomerates are given below in Table I.

TABLE I

| | (% weight) | |
|---|---|---|
| Component | I | II |
| HLAS | 23 | 27.1 |
| Sodium carbonate (soda ash) | 10 | 20.8 |
| STPP | 32 | 31.3 |
| Burkeite | 30 | 20.8 |
| Zeolite A | 5 | — |
| wt. ratio Burkeite/soda ash | 3/1 | 1/1 |
| Bulk Density (g/l) | 471 | 420 |
| Cake strength (kg/sq. inch) | 0.89 | 0.62 |

Unexpectedly, the resulting agglomerates have a bulk density below 500 g/L and show excellent cake strength and flowability.

COMPARATIVE EXAMPLES III–IV

These Examples describe compositions made by the process described in the Examples I–II with except that either sodium carbonate or Burkeite is omitted. The following compositions are made as shown in Table II.

TABLE II

| Component | (% weight) III | IV |
|---|---|---|
| HLAS | 23 | 23 |
| Sodium carbonate (soda ash) | 40 | — |
| STPP | 32 | 32 |
| Burkeite | — | 40 |
| Zeolite A | 5 | 5 |
| wt. ratio Burkeite/soda ash | 0/1 | 1/0 |
| Bulk Density (g/l) | 555 | 558 |
| Cake strength (kg/sq. inch) | 0.24 | 2.05 |

The bulk density of the resulting agglomerates considerably higher than 600 g/l, sticky and not free-flowing as a result of the exclusion of sodium carbonate or Burkeite from the process which is therefore outside the scope of the instant process invention.

COMPARATIVE EXAMPLES V–VI

The compositions in these Examples are made by the batch mode process described in Examples I–II but do not contain Burkeite. Rather the compositions contain separate amounts of spray-dried sulfate and spray-dried carbonate. The compositions are shown in Table IV.

TABLE IV

| Component | V | VI |
|---|---|---|
| HLAS | 23 | 23 |
| Sodium carbonate | 10 | 10 |
| STPP | 32 | 32 |
| Zeolite A | 5 | 5 |
| Spray dried $Na_2SO_4$ | 30 | — |
| Spray dried $Na_2CO_3$ | — | 30 |
| Bulk Density (g/L) | not agglomerable(lumps) | 438 |
| Spray dried $Na_2CO_3$ | — | 30 |
| Bulk Density (g/L) | not agglomerable(lumps) | 438 |
| Cake strength (kg/sq. inch) | >3 | 1.94 |

Comparative Example V does not have the desired low density. While comparative Example VI has low density, the resulting agglomerates are sticky and not free-flowing.

Having thus described the invention in detail, it will be obvious to those skilled in the art that various changes may be made without departing from the scope of the invention and the invention is not to be considered limited to what is described in the specification.

What is claimed is:

1. A process for preparing a low density detergent composition comprising the steps of:

(a) agglomerating a detergent surfactant paste and dry starting detergent material in a high speed mixer to obtain detergent agglomerates, wherein said dry staring detergent material includes $Na_2SO_4.Na_2CO_3$ and sodium carbonate in a weight ratio of from about 1:10 to about 10:1; and (b) drying said detergent agglomerates so as to form said detergent composition having a density of from about 300 g/l to 500 g/l.

2. A process according to claim 1 wherein said dry starting material further comprises a builder selected from the group consisting of aluminosilicates, crystalline layered silicates, phosphates, and mixtures thereof.

3. A process according to claim 1 wherein the mean residence time of said detergent agglomerates in said high speed mixer is in range from about 2 seconds to about 45 seconds.

4. A process according to claim 1 further comprising the step of agglomerating said detergent agglomerates in a moderate speed mixer after said high speed mixer.

5. A process according to claim 4 wherein the mean residence time of said detergent agglomerates in said moderate speed mixer is in range frown about 0.5 minutes to about 15 minutes.

6. A process according to claim 1 wherein said surfactant paste has a viscosity of from about 5,000 cps to about 100,000 cps.

7. A process according to claim 1 wherein said surfactant paste comprises water and a surfactant selected from the group consisting of anionic, nonionic, zwitterionic, ampholytic and cationic surfactants and mixtures thereof.

8. A process according to claim 1 wherein said weight ratio of $Na_2SO_4.Na_2CO_3$ sodium carbonate is from about 1:5 to about 5:1.

9. A process according to claim 1 wherein said $Na_2SO_4.Na_2CO_3$ is anhydrous.

10. A process for preparing a low density detergent composition comprising the steps of:

(a) agglomerating a liquid acid precursor of anionic surfactant and dry starting detergent material in a high speed mixer to obtain detergent agglomerates, wherein said dry starting detergent material includes $Na_2SO_4.Na_2CO_3$ and sodium carbonate in a weight ratio of from about 1:10 to about 10:1; and (b) cooling said detergent agglomerates so as to form said detergent composition having a density of from about 300 g/l to 500 g/l.

11. A process according to claim 10 wherein said dry starting material further comprises a builder selected from the group consisting of aluminosilicates, crystalline layered silicates, phosphates, and mixtures thereof.

12. A process for preparing a low density detergent composition comprising the steps of:

(a) agglomerating a detergent surfactant paste and dry starting detergent material in a high speed mixer to obtain detergent agglomerates, wherein said dry starting detergent material includes $Na_2SO_4.Na_2CO_3$ and sodium carbonate in a weight ratio of from about 1:10 to about 10:1;

(b) mixing said detergent agglomerates in a moderate speed mixer to further agglomerate said detergent agglomerates; and (c) drying said detergent agglomerates so as to form said low density detergent composition having a density of from 300 g/l to about 500 g/l.

13. A process according to claim 12 wherein said weight ratio of $Na_2SO_4.Na_2CO_3$ to sodium carbonate is from about 1:2 to about 3:1.

* * * * *

UNITED STATES PATENT AND TRADEMARK OFFICE

CERTIFICATE OF CORRECTION

PATENT NO. : 5,576,285

DATED : November 19, 1996

INVENTOR(S) : France et al.

It is certified that error appears in the above-indentified patent and that said Letters Patent is hereby corrected as shown below:

Column 1, line 61, change "toughened" to -- roughened --.

Column 5, line 17, change "frown" to -- from --

Column 11, line 64, change "staring" to -- starting --

Column 12, line 19, change "frown" to -- from --

Signed and Sealed this

Eighth Day of July, 1997

Bruce Lehman

*Attest:*

BRUCE LEHMAN

*Attesting Officer*

*Commissioner of Patents and Trademarks*